US007101256B2

(12) United States Patent
Sudo

(10) Patent No.: US 7,101,256 B2
(45) Date of Patent: Sep. 5, 2006

(54) MACHINING APPARATUS USING A ROTARY MACHINE TOOL TO MACHINE A WORKPIECE

(75) Inventor: Masaaki Sudo, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/152,070

(22) Filed: Jun. 15, 2005

(65) Prior Publication Data

US 2006/0068683 A1 Mar. 30, 2006

(30) Foreign Application Priority Data

Sep. 29, 2004 (JP) ..... 2004-284295

(51) Int. Cl.
*B24B 49/00* (2006.01)

(52) U.S. Cl. ..... 451/5; 451/6; 451/450

(58) Field of Classification Search ..... 451/5, 451/6, 8, 7, 449, 450, 178, 231
See application file for complete search history.

(56) References Cited

U.S. PATENT DOCUMENTS 4,822,218 A * 4/1989 Satoh ..... 409/136
4,944,121 A * 7/1990 Takahashi et al. ..... 451/450
6,010,396 A * 1/2000 Ohmiya ..... 451/450
6,123,606 A * 9/2000 Hill et al. ..... 451/53
6,126,526 A * 10/2000 Herrscher et al. ..... 451/259
6,224,462 B1 * 5/2001 Yokoyama et al. ..... 451/10
6,454,636 B1 * 9/2002 Iwabuchi ..... 451/53
6,585,564 B1 * 7/2003 Hiramoto et al. ..... 451/7

FOREIGN PATENT DOCUMENTS

JP 406055432 * 3/1994
JP 2893641 3/1999
JP 11-347934 12/1999

OTHER PUBLICATIONS

Mizuno, et al., "Effect of blade guide on cutoff accuracy in cutoff grinding with very-thin OD-blade", Journal of the Japan Society for Abrasive Technology, vol. 46, No. 10, pp. 515-520, Oct. 2002.

* cited by examiner

*Primary Examiner*—Ellen P. Morgan
(74) *Attorney, Agent, or Firm*—Finnegan, Henderson, Farabow, Garrett & Dunner, L.L.P.

(57) ABSTRACT

A machining apparatus includes a rotary machine tool for machining a workpiece. A nozzle jets a coolant for the rotary machine tool. Information which changes based on a position of the nozzle is obtained. The nozzle is moved based on the information obtained.

4 Claims, 5 Drawing Sheets

MACHINING APPARATUS USING A ROTARY MACHINE TOOL TO MACHINE A WORKPIECE

CROSS REFERENCE TO RELATED APPLICATION

This application is based upon and claims the benefit of priority from prior Japanese Patent Application No. 2004-284295 filed on Sep. 29, 2004, the entire contents of which are incorporated herein by reference.

BACKGROUND

1. Technical Field

The present invention relates to a machining apparatus and a method of machining and, more particularly, to a machining apparatus using a rotary machine tool to machine a workpiece and a method of machining to machine a workpiece by a rotary machine tool.

2. Description of the Related Art

FIGS. 5A and 5B show end and side views of a conventional machining apparatus. The apparatus is a dicing apparatus provided with a spindle 100 which rotates at a high speed, a grinder 101 held by spindle 100, and a chuck table 102 to fix or hold a workpiece 103, such as a semiconductor wafer to be diced by cutting or grooving by pressing grinder 101 onto workpiece 103.

When workpiece 103 is cut or grooved, large quantities of working dust are produced. A nozzle 104 is therefore provided to jet a cutting liquid L onto grinder 101 and workpiece 103 to remove the working dust and to cool grinder 101 and workpiece 103.

Japanese Patent Publication No. 11-347934 (kokai) shows nozzle 104 which is arranged to face the peripheral surface of grinder 101. Nozzle 104 is moveable in X, Y, and Z directions such as shown in FIGS. 5A and 5B, and is further rotatable around the Y axis to be adjusted to a most preferred position.

Another machining apparatus with two nozzles to supply cutting liquid for a grinder L and a workpiece, respectively, is also known. Further, yet another conventional machining apparatus includes a nozzle having a bellows shape.

Meanwhile, a grinder may need to be replaced according to a material, a shape, and a specification of a workpiece before cutting or grooving. When replacing a grinder, the nozzle needs to be moved to a position which does not interfere with the replacement of the grinder. After replacement of the grinder, the nozzle accordingly needs to be rearranged to a most preferred position for grooving or cutting.

An operator manually arranges the position of the nozzle based upon his/her experience. It is accordingly difficult for an operator who has less experience to rearrange the nozzle to the most preferred position. Therefore, the nozzle may be misaligned. As a result, a fluctuation in grinding accuracy increases.

SUMMARY

One aspect of the present invention relates to a machining apparatus. The apparatus comprises a rotary machine tool to machine a workpiece, a nozzle to supply a liquid coolant for the rotary machine tool, means for obtaining information which changes based on a position of the nozzle, and means for moving the nozzle based on the obtained information.

Another aspect of the present invention relates to a machining apparatus. The machining apparatus comprises a rotary machine tool to machine a workpiece, a nozzle to supply a liquid coolant for the rotary machine tool, a sensor to obtain information which changes based on a position of the nozzle, and an actuator to move the nozzle based on the information obtained by the sensor.

In accordance with a further aspect of the present invention, there is provided a method of machining. The machining method comprises machining a workpiece using a rotary machine tool, supplying a liquid coolant with a nozzle for the rotary machine tool, obtaining information which changes based on a position of the nozzle, and moving the nozzle based on the information obtained.

DETAILED DESCRIPTION (A First Embodiment)

Figure 1A:
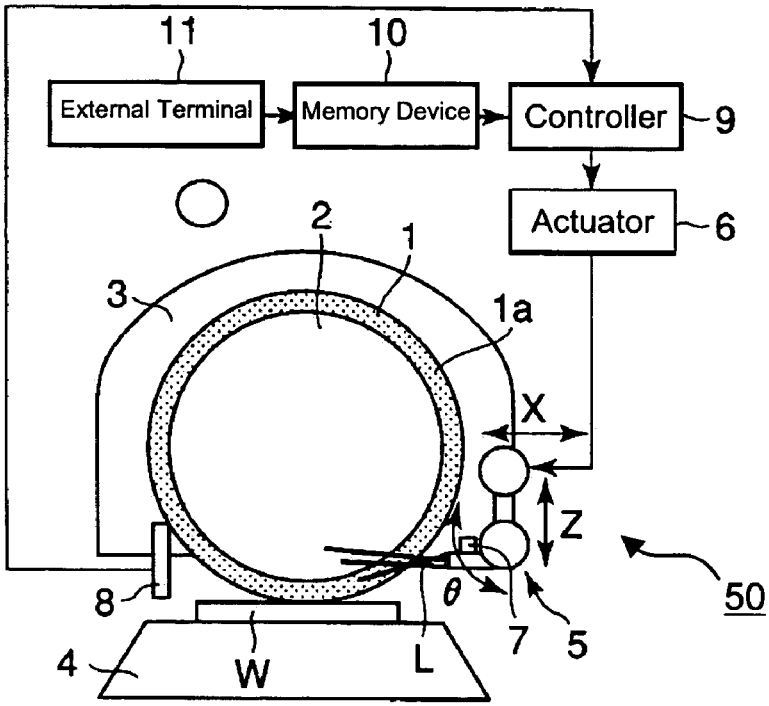
FIGS. 1A and 1B show end and side views of a machining apparatus consistent with a first embodiment of the invention.
Figure 1B:
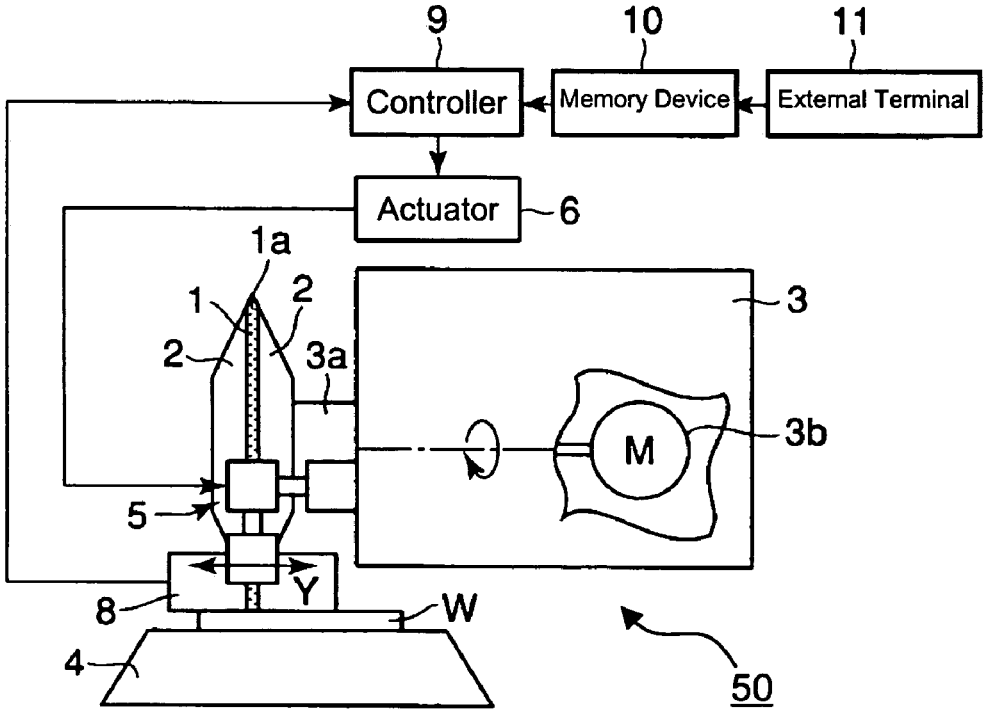

A first embodiment will be explained with reference to FIGS. 1A and 1B. FIGS. 1A and 1B respectively show end and side views of a machining apparatus 50 consistent with the first embodiment. Machining apparatus 50 is a dicing apparatus to cut or groove a workpiece such as a semiconductor wafer. Machining apparatus 50 is provided with a thin circular grinder 1 which is clamped between two flanges 2. A driving axle 3*a*, horizontally extending from a spindle 3, is connected to a radial center of grinder 1.

Spindle 3 includes a motor 3*b* to rotate driving axle 3*a* at a high speed. Grinder 1 is thereby rotated by motor 3*b*. A cutting surface 1*a* of grinder 1 slightly projects in the radial direction beyond the outside of the peripheral parts of flanges 2. The periphery of grinder 1 corresponds to cutting surface 1*a* to groove or cut a workpiece W.

A chuck table 4 detachably holds workpiece W in a fixed position by applying a vacuum force to workpiece W. Alternatively, workpiece W may be fixed in position by being held in wax.

A nozzle 5 to jet cutting liquid L, which is also used as a coolant, toward grinder 1 and workpiece W is arranged to face the cutting surface of grinder 1. Nozzle 5 is moveable in X, Y, and Z directions noted in FIGS. 1A and 1B. Nozzle 5 can further rotate to displace an angle θ, by rotation around an axis along the Y direction. The position of nozzle 5 and the angle thereof can be set by an actuator 6.

Actuator 6 may be a screw feeding mechanism, a gear drive mechanism, a piezoelectric actuator, and so on. Use of a piezoelectric actuator can enable fine position adjustment on the order of microns.

A light source 7 is attached to a tip part of nozzle 5 to direct light toward grinder 1. A sectional center of a light beam emitted from light source 7 is aligned so as to substantially correspond to a sectional center of the cutting liquid jetted from nozzle 5. Light source 7 may be provided as a semiconductor laser directly attached to an upper part of the tip of nozzle 5.

A photo-detector 8 is arranged to face light source 7 on an opposite side of grinder 1, to detect an intensity distribution of the light beam. Photodector 8 outputs information about the light intensity distribution to a controller 9.

Since the light beam emitted from light source 7 is diffusely reflected off cutting liquid L which is jetted from nozzle 5, and is also blocked by grinder 7, the intensity distribution of the light beam that reaches the opposite side of grinder 1 changes according to the position and angle of nozzle 5. The position and angle of nozzle 5 can be calculated based on the intensity distribution which is detected by photo-detector 8.

Controller 9 controls actuator 6 based on both the information of the detected intensity distribution outputted from photo-detector 8 and information regarding a most preferred intensity distribution already stored in a memory device 10, in order to move nozzle 5 to a most preferred position.

The most preferred position of nozzle 5 is the position where nozzle 5 jets cutting liquid most effectively. The most preferred intensity distribution is the intensity distribution of the light beam that photo-detector 8 detects when nozzle 5 is positioned at the most preferred position. In other words, when photo-detector 8 detects the most preferred intensity distribution, nozzle 5 is presumed to be set at the most preferred position.

Memory device 10 also can store information regarding the most preferred position of nozzle 5 as coordinate data (X, Y, Z, θ). The coordinate data can be stored by inputting the data through an external terminal 11.

The operation of machining apparatus 50 will be explained next.

Chuck table 4 holds workpiece W. Grinder 1 then starts rotating and is moved to bring cutting surface 1*a* of grinder 1 to the surface of workpiece W. Alternatively, a mechanism could be provided to move chuck table 4 to bring the cutting surface 1*a* to the surface of workpiece W. 5 jets cutting liquid L. Photo-detector 8 detects an intensity distribution of a light beam emitted from light source 7.

The light intensity distribution detected by photo-detector 8 is outputted to controller 9, and compared to the light intensity distribution stored in memory device 10. Controller 9 outputs a control signal to control actuator 6 to move nozzle 5 so as to conform the detected intensity distribution to the most preferred intensity distribution stored in memory device 10. As a result of such movement, nozzle 5 is positioned at the most preferred position, and cutting liquid L jetted from nozzle 5 is supplied most preferably for machining.

After nozzle 5 is positioned at the most preferred position, grinder 1 is further moved downward to start cutting or grooving workpiece W.

Thus machining apparatus 50 is operated such that nozzle 5 is automatically positioned at the most preferred position by driving actuator 6 based upon the information of the intensity distribution of a light beam which is emitted from light source 7 and detected by photo-detector 8.

As a result, nozzle 5 is accurately and repeatably set at the most preferred position. Grooving or cutting of workpiece W can be carried out with almost the same precision regardless of skill levels of operators who operate machining apparatus 50. A uniformity of the machining accuracy improves. Consumption of cutting liquid can be also reduced.

A second embodiment will be explained with reference to FIGS. 2A and 2B. Explanation of the same structure as shown in the first embodiment is omitted.

Figure 2A:
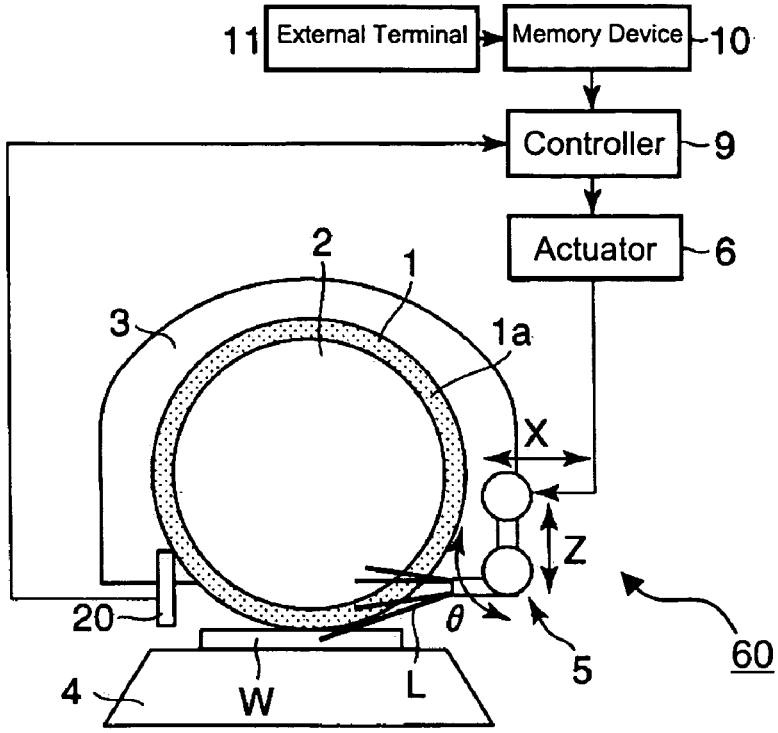
FIGS. 2A and 2B show end and side views of a machining apparatus consistent with a second embodiment of the invention.
Figure 2B:
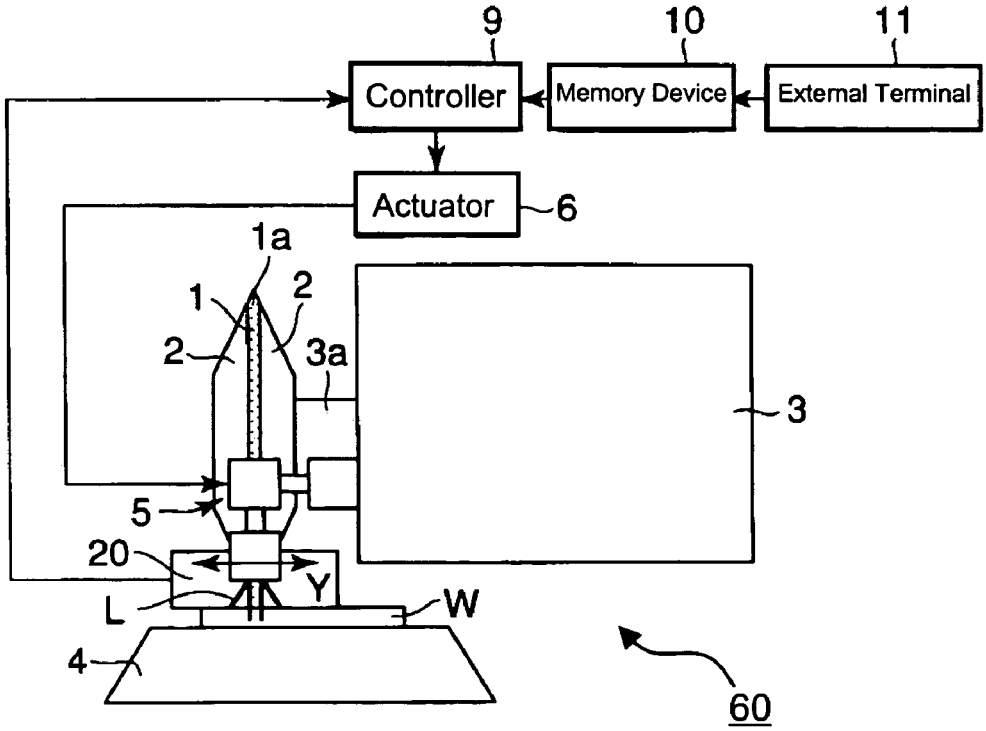

FIGS. 2A and 2B respectively show end and side views of a machining apparatus 60 consistent with the second embodiment. Machining apparatus 60 includes a pressure sensor 20 to detect information regarding the position and angle of nozzle 5, instead of light source 7 and photo-detector 8. Pressure sensor 20 is set on the opposite side of grinder 1 from nozzle 5. Pressure sensor 20 detects an hydraulic pressure distribution of cutting liquid L, and outputs information regarding the hydraulic pressure distribution to controller 9.

Since pressure sensor 20 can detect the position and angle of nozzle 5 instead of light source 7 and photo-detector 8, controller 9 coupled to sensor 20 can control actuator 6 based on both the hydraulic pressure distribution information outputted from pressure sensor 20 and information regarding a most preferred pressure distribution already stored in memory device 10. Since the most preferred pressure distribution corresponds to the most preferred position of nozzle 5, by such control, actuator 6 can automatically move nozzle 5 to the most preferred position with accuracy in a short time based upon the detected hydraulic pressure distribution information.

Figure 3A:
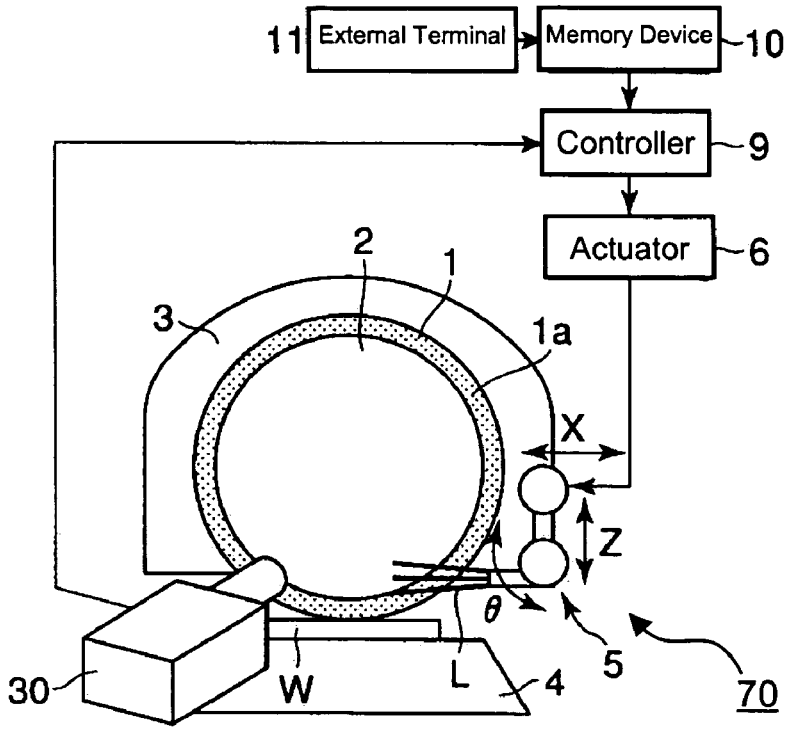
FIGS. 3A and 3B show end and side views of a machining apparatus consistent with a third embodiment of the invention.
Figure 3B:
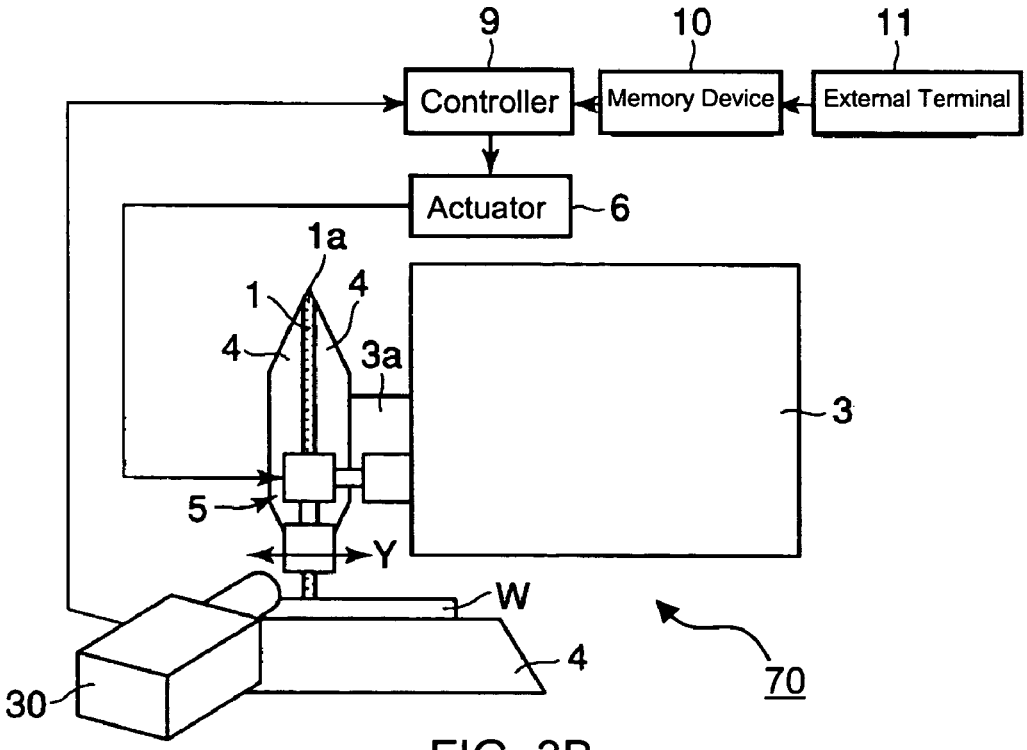

Referring to FIGS. 3A and 3B, a third embodiment will be explained. Explanation of the same structure as shown in the first embodiment is omitted.

FIGS. 3A and 3B respectively show end and side views of a machining apparatus 70 consistent with the third embodiment. A camera 30 is provided as a sensor and is positioned to detect the position and angle of nozzle 5, instead of pressure sensor 20, or light source 7 and photo-detector 8. Since camera 30 is placed at a location angularly displaced from the side surface of grinder 1, camera 30 can obtain an oblique image of nozzle 5 and grinder 1.

It is thus possible for camera 30 to obtain information on the position and angle of nozzle 5. Controller 9 is coupled to camera 30 and can control actuator 6 based on both the image data outputted by camera 30 and information regarding a most preferred image, corresponding to the most preferred position of nozzle 5, already stored in memory device 10. By such control, actuator 6 can automatically move nozzle 5 to the most preferred position with accuracy in a short time based upon the detected information.

A fourth embodiment will be explained with reference to FIGS. 4A and 4B. Explanation of the same structure as shown in the first embodiment is omitted.

Figure 4A:
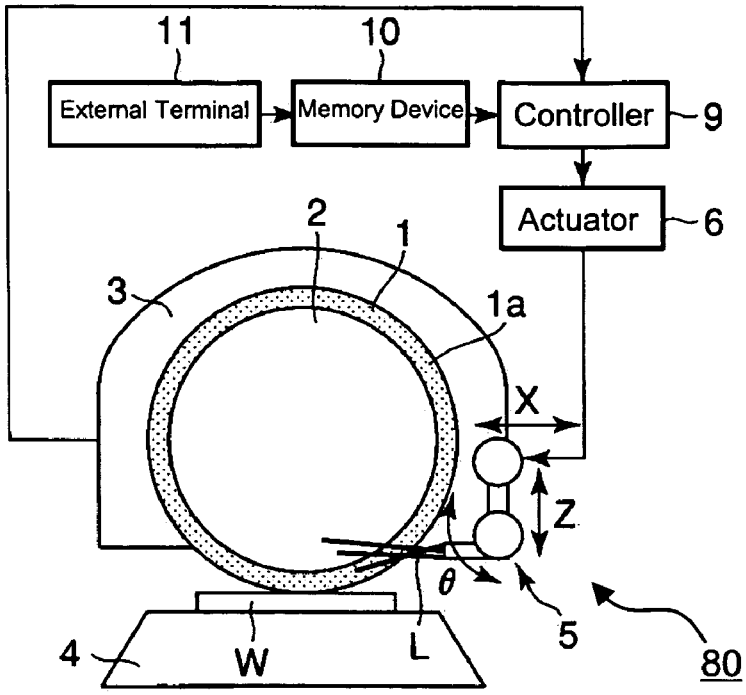
FIGS. 4A and 4B show end and side views of a machining apparatus consistent with a fourth embodiment of the invention.
Figure 4B:
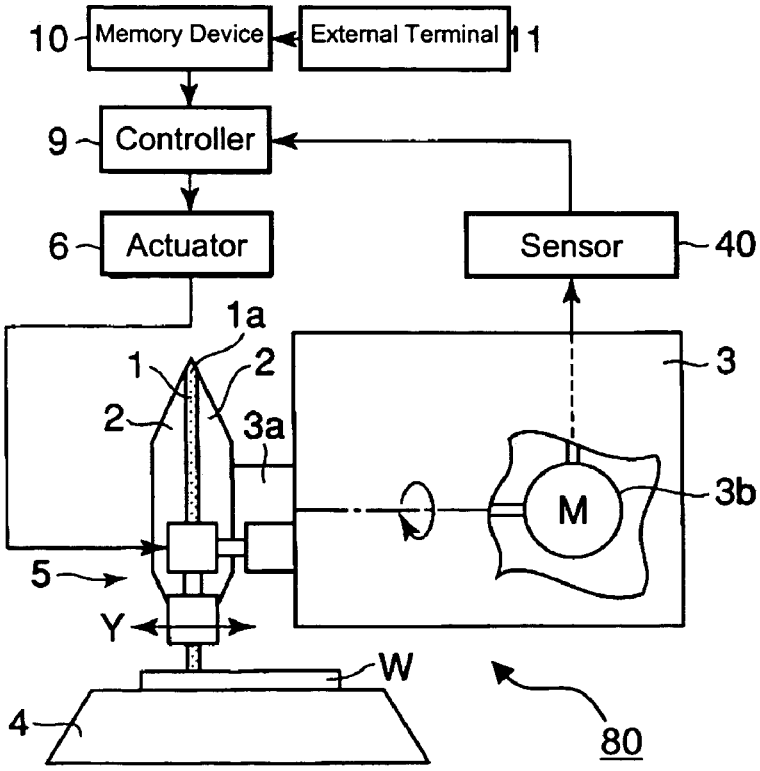
Figure 5A:
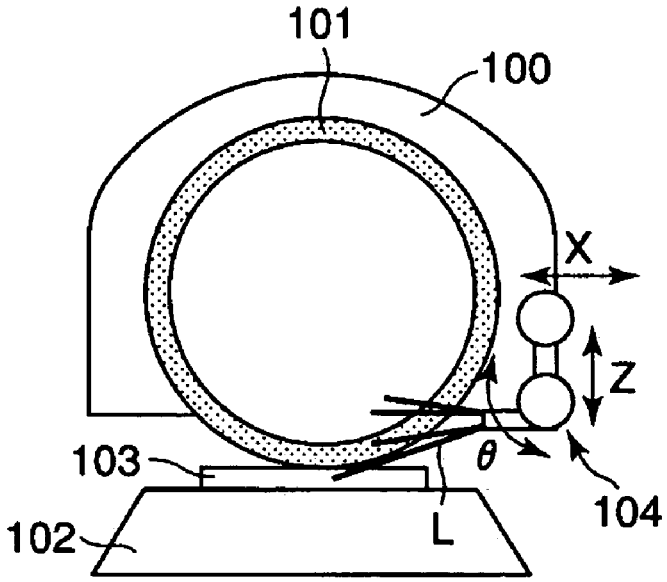
FIGS. 5A and 5B show end and side views of a conventional machining apparatus.
Figure 5B:
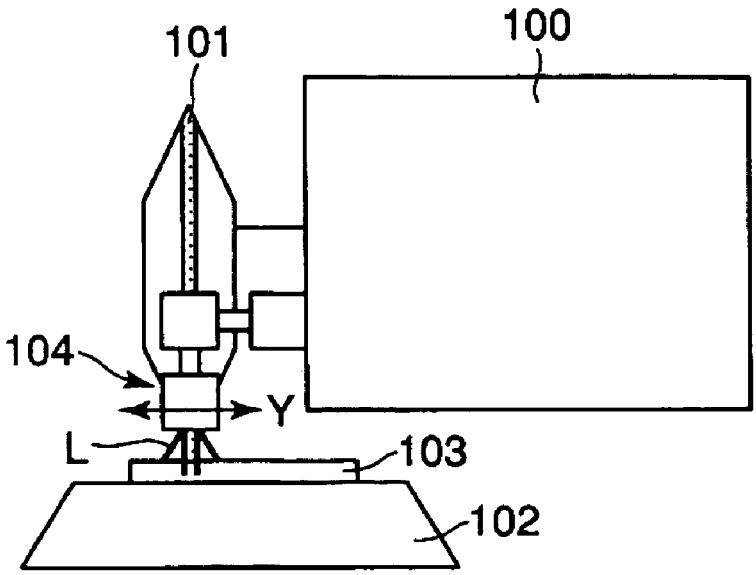

FIGS. 4A and 4B respectively show end and side views of a machining apparatus 80 consistent with the fourth embodiment. As shown in FIGS. 4A and 4B, machining apparatus 80 is provided with a sensor 40 to detect a load on motor 3*b* in order to obtain information which changes according to a position of nozzle 5, instead of light source 7 and photo-detector 8, pressure sensor 20, or camera 30. Sensor 40 detects a slight change in the load or motor 3*b* caused by a change in a supply of cutting liquid L for grinder 1.

The information of the load detected is outputted to controller 9. Controller 9 can control actuator 6 based on both the motor load information and information regarding a most preferred motor load, corresponding to the most preferred position of nozzle 5, already stored in memory device 10. By such control, actuator 6 can automatically move nozzle 5 to the desired position and angle based on detection of the load on motor 3*b*, and changes thereof, caused by cutting liquid L.

Thus, it is possible for sensor 40 to obtain information relating to the position and angle of nozzle 5. As a result, nozzle 5 can be automatically moved to the most preferred position with accuracy in a short time by controlling actuator 6 based upon the detected information.

Numerous modifications of these embodiments are possible in light of the above teachings. It is therefore to be understood that, within the scope of the appended claims, the present invention can be practiced in a manner other than as specifically described herein. Some elements shown in selected embodiments may be omitted, while other elements shown in other embodiments may be added to the disclosed machining apparatus, if necessary.

What is claimed is:

1. A machining apparatus comprising:

a rotary machine tool to machine a workpiece;

a nozzle to supply a liquid coolant for the rotary machine tool;

means for obtaining information that changes based on a position of the nozzle;

means for moving the nozzle based on the obtained information; and a light source to emit a light beam toward the coolant, wherein the obtaining means includes a photo-detector to detect an intensity distribution of the light beam which reflects off the coolant.

2. A machining apparatus according comprising:

a rotary machine tool to machine a workpiece;

a nozzle to supply a liquid coolant for the rotary machine tool;

means for obtaining information that changes based on a position of the nozzle; and means for moving the nozzle based on the obtained information, wherein the obtaining means includes a pressure sensor to detect a pressure of the coolant which is scattered by the rotary machine tool.

3. A machining apparatus comprising:

a rotary machine tool to machine a workpiece;

a nozzle to supply a liquid coolant for the rotary machine tool;

means for obtaining information that changes based on a position of the nozzle: and means for moving the nozzle based on the obtained information, wherein the obtaining means includes a camera to obtain an image of the nozzle.

4. A machining apparatus comprising:

a rotary machine tool to machine a workpiece;

a nozzle to supply a liquid coolant for the rotary machine tool;

means for obtaining information that changes based on a position of the nozzle;

means for moving the nozzle based on the obtained information; and a motor to rotate the rotary machine tool, wherein the obtaining means includes a sensor to detect a load on the motor.

* * * * *